US011230354B2

(12) United States Patent
Beutler

(10) Patent No.: US 11,230,354 B2
(45) **Date of Patent: *Jan. 25, 2022**

(54) DRAIN APPARATUS FOR MARINE VESSEL

(71) Applicant: Georg Fischer Harvel LLC, Little Rock, AR (US)

(72) Inventor: Michael Paul Beutler, Cabot, AR (US)

(73) Assignee: Georg Fischer Harvel LLC, Little Rock, AR (US)

( * ) Notice: Subject to any disclaimer, the term of this patent is extended or adjusted under 35 U.S.C. 154(b) by 191 days.

This patent is subject to a terminal disclaimer.

(21) Appl. No.: 16/654,321

(22) Filed: Oct. 16, 2019

(65) Prior Publication Data

US 2020/0047851 A1 Feb. 13, 2020

Related U.S. Application Data

(63) Continuation-in-part of application No. 15/971,313, filed on May 4, 2018, now Pat. No. 10,604,926.

(51) Int. Cl.
*B63B 13/00* (2006.01)

(52) U.S. Cl.
CPC ..... *B63B 13/00* (2013.01)

(58) Field of Classification Search
CPC ..... B63B 13/00
See application file for complete search history.

(56) References Cited

U.S. PATENT DOCUMENTS

| | | | | |
|---|---|---|---|---|
| 4,533,331 | A | 8/1985 | Bland | |
| 4,631,861 | A * | 12/1986 | Wuthrich | A01G 9/12 47/70 |
| 6,131,323 | A * | 10/2000 | Wong | A01G 9/0295 40/645 |
| 6,406,071 | B1 | 6/2002 | LaViola et al. | |
| 10,604,926 | B2 * | 3/2020 | Beutler | B63B 13/00 |
| 2007/0034577 | A1 | 2/2007 | Bayard et al. | |
| 2016/0002906 | A1 | 1/2016 | Adams | |

* cited by examiner

*Primary Examiner* — Stephen P Avila
(74) *Attorney, Agent, or Firm* — Harness, Dickey & Pierce, P.L.C.

(57) ABSTRACT

A drain pot includes a body and at least one elongated catch. The body has an inlet and an outlet. The inlet and the outlet are at opposing ends of the body and in fluid communication with each other. The at least one elongated catch extends from and around the body. A portion of the body extends radially outwardly further than the at least one elongated catch.

20 Claims, 14 Drawing Sheets

DRAIN APPARATUS FOR MARINE VESSEL

CROSS-REFERENCE TO RELATED APPLICATIONS

This application is a continuation-in-part of U.S. patent application Ser. No. 15/971,313 filed on May 4, 2018. The entire disclosure of the above application is incorporated herein by reference.

FIELD

The present disclosure relates to a drain apparatus for a marine vessel.

BACKGROUND

This section provides background information related to the present disclosure which is not necessarily prior art.

Drains for marine vessels are generally manufactured using a metal material (e.g., stainless steel or steel) and welded within an opening in the deck of the vessel. The metals drains are susceptible to corrosion and often require special connections to adapt to non-metallic marine vessel piping systems. Furthermore, the installation of these metal drains often present conditions that are unfavorable to the installer. The present disclosure provides a drain that is not subject to corrosion and is also conveniently installed into the deck of the marine vessel.

SUMMARY

This section provides a general summary of the disclosure, and is not a comprehensive disclosure of its full scope or all of its features.

In one form, the present disclosure provides a drain pot that includes a body and at least one elongated catch. The body has an inlet and an outlet. The inlet and the outlet at opposing ends of the body and in fluid communication with each other. The at least one elongated catch extends from and at least partially around the body. A portion of the body extends radially outwardly further than the at least one elongated catch.

In some configurations of the drain pot of the above paragraph, the body is annular-shaped.

In some configurations of the drain pot of any one or more of the above paragraphs, the body includes a top portion, bottom portion and an intermediate portion disposed between the top portion and the bottom portion. The inlet is disposed at the top portion and the outlet is disposed at the bottom portion.

In some configurations of the drain pot of any one or more of the above paragraphs, the at least one elongated catch extends from the intermediate portion of the body and cooperates with the top portion to define a slot.

In some configurations of the drain pot of any one or more of the above paragraphs, the at least one elongated catch is arcuate.

In some configurations of the drain pot of any one or more of the above paragraphs, the body and the at least one elongated catch is made of a polymeric material.

In some configurations of the drain pot of any one or more of the above paragraphs, the at least one elongated catch includes a vertical member and a horizontal member that extends from an end of the vertical member.

In another form, the present disclosure provides a drain apparatus for a deck in a marine vessel. The drain apparatus includes an adapter and a drain pot. The adapter is disposed within an opening in the deck of the marine vessel and is attached to the deck of the marine vessel. The drain pot is configured to be removably installed within the adapter and includes a body and at least one elongated catch. The body has an inlet and an outlet at opposing ends thereof and in fluid communication with each other. The at least one elongated catch extends from and disposed at least partially around the body and engaging the adapter.

In some configurations of the drain apparatus of the above paragraph, a housing is disposed within the opening in the deck and attached to the deck. The adapter is disposed within the housing and fixedly attached to the housing.

In some configurations of the drain pot of any one or more of the above paragraphs, a fire stop is configured to be removably installed in a gap formed between the housing and the body of the drain pot.

In some configurations of the drain pot of any one or more of the above paragraphs, the drain pot is made of a polymeric material.

In yet another form, the present disclosure provides a drain apparatus for a deck in a marine vessel. The drain apparatus includes an annular deck adapter and a drain pot. The annular deck adapter is configured to fit within an opening in the deck of the marine vessel. The adapter includes an annular body having a top end, a bottom end and a side wall extending from the top end to the bottom end. The body extends downwardly in the opening in the deck. A lip extends radially inwardly from the bottom end of the body. A ledge extends radially inwardly from the lip such that the ledge extends radially inwardly a further distance than the lip. The drain pot is configured to be removably installed within the body of the adapter.

In some configurations of the drain apparatus of the above paragraph, the drain pot includes at least one elongated catch for engaging the ledge of the adapter.

In some configurations of the drain pot of any one or more of the above paragraphs, the top end of the body is positioned below a surface of the deck.

In some configurations of the drain pot of any one or more of the above paragraphs, the drain pot includes a body having a top portion, bottom portion and an intermediate portion extending between the top portion and the bottom portion.

In some configurations of the drain pot of any one or more of the above paragraphs, the top portion extends radially outwardly from the intermediate portion and is seated on a top side of the ledge of the adapter.

In some configurations of the drain pot of any one or more of the above paragraphs, a drain plate disposed on an inwardly projecting ledge formed in the top portion of the drain pot, above the ledge of the adapter and adjacent an end of the body of the drain pot.

In some configurations of the drain pot of any one or more of the above paragraphs, the at least one elongated catch extends from the body of the drain pot and cooperates with the top portion to define a slot.

In some configurations of the drain pot of any one or more of the above paragraphs, the drain pot is inserted into the adapter and rotated in one direction so that the ledge is received in the slot to prevent the drain pot from being removed from the opening in the deck and the drain pot is removed from the deck by rotating the drain pot in an opposite direction to disengage the ledge from the slot to allow the drain pot to be removed from the opening in the deck.

In some configurations of the drain pot of any one or more of the above paragraphs, the catch is arcuate.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
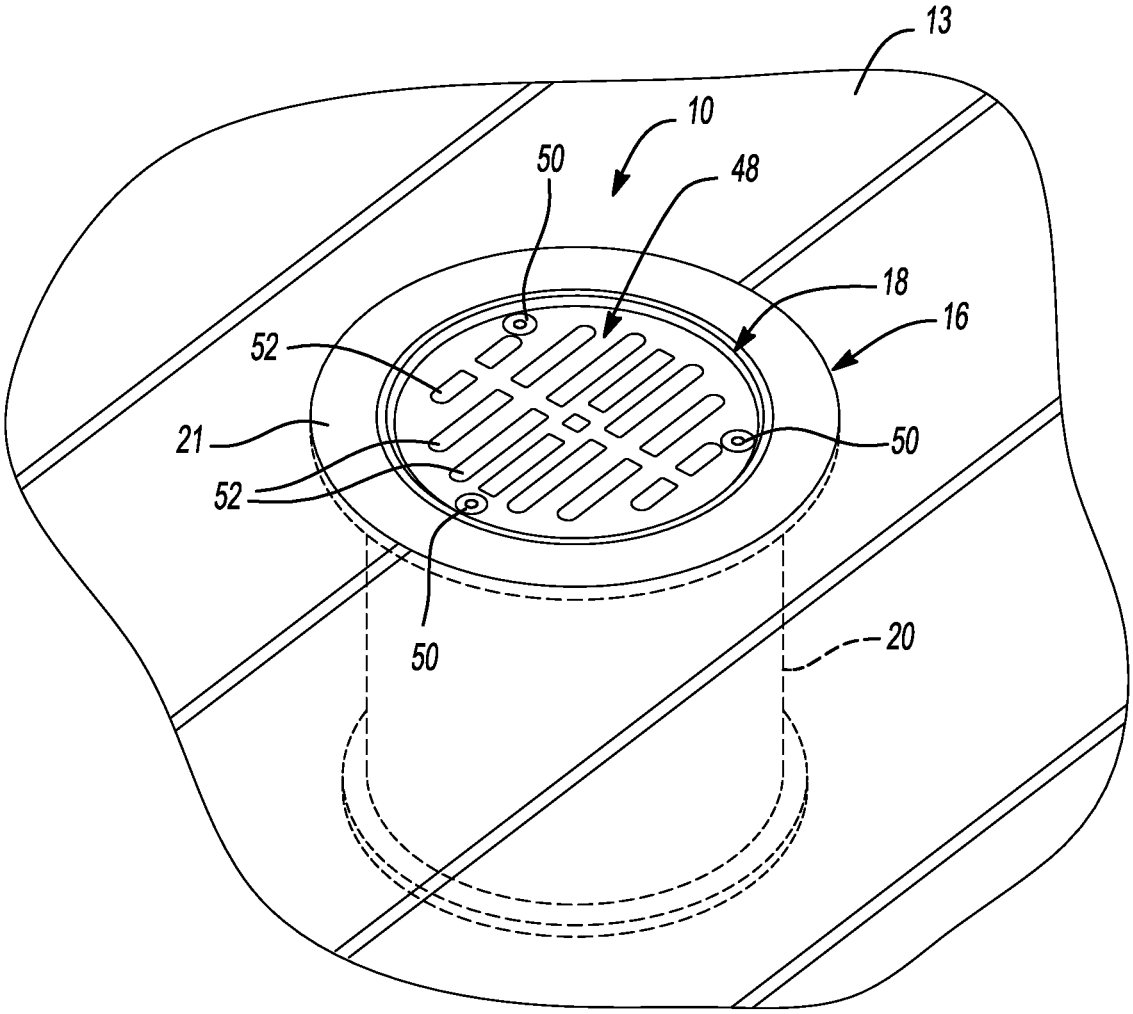
FIG. 1 is a perspective view of a drain apparatus disposed in an opening of a floor according to the principles of the present disclosure.
Figure 2:
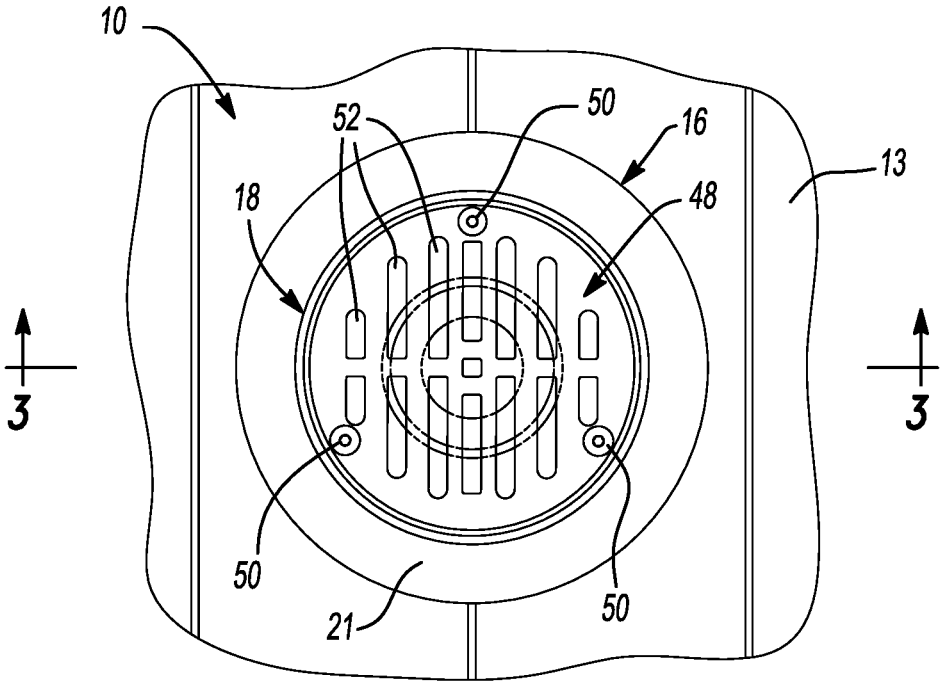
FIG. 2 is a top view of the drain apparatus of FIG. 1 disposed in the opening of the floor.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-5, a drain apparatus 10 is provided. The drain apparatus 10 is disposed within an opening 12 in a floor 13 (e.g., a deck in a marine vessel) such that fluids and debris may drain therefrom and into a drain system 14 attached to the drain apparatus 10 (via a fitting 15). The drain apparatus 10 includes a deck adapter 16, a drain pot 18 and a fire stop 19. The deck adapter 16 is annular-shaped and made of a metallic material. The deck adapter 16 is disposed within the opening 12 in the floor 13 and fixedly attached to the floor 13 using any suitable method of attachment (e.g., welding). The deck adapter 16 includes an annular body 20, a flange 21 and a ledge 22.

Figure 3:
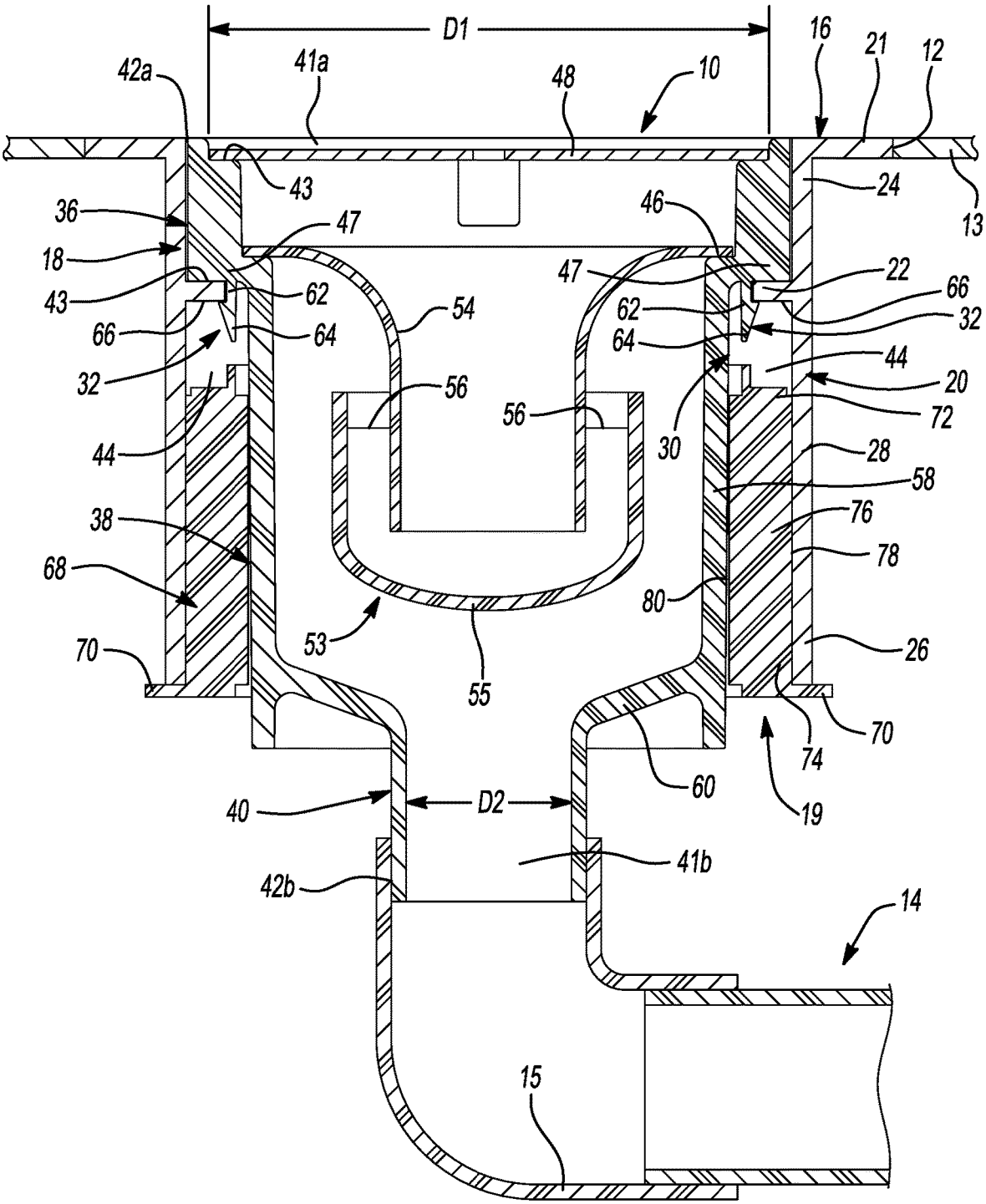
FIG. 3 is a cross-sectional view of the drain apparatus taken along line 3-3 of FIG. 2.
Figure 4:
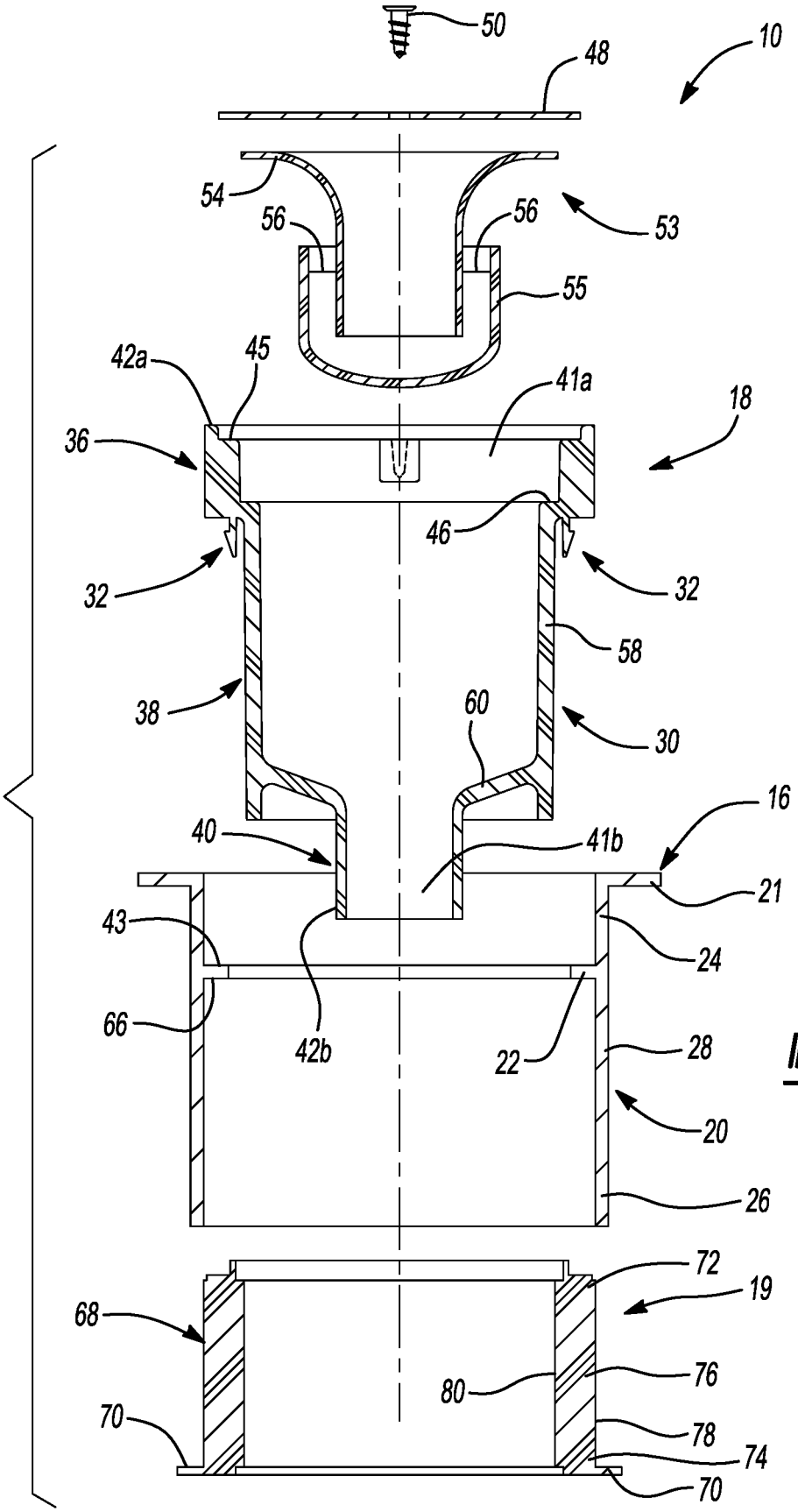
FIG. 4 is an exploded view of the drain apparatus.

The annular body 20 includes a top end 24, a bottom end 26 and a side wall 28 extending from the top end 24 to the bottom end 26. The flange 21 extends radially outwardly from the top end 24 of the body 20 and is configured to lie flush with the floor 13 (FIG. 3). The ledge 22 extends radially inwardly from the side wall 28 of the body 20 opposite the flange 21.

The drain pot 18 is annular-shaped and made of a polymeric material (e.g., cPVC). The drain pot 18 is configured to be removably installed within the body 20 of the adapter 16 such that fluids and debris on the floor 13 may drain therefrom and into the drain system 14 attached to the drain pot 18 (via the fitting 15). The drain pot 18 includes a body 30 and a plurality of flexible catches 32.

The body 30 is annular-shaped and includes a top portion or shoulder 36, an intermediate portion 38 and a bottom portion or spigot 40. The body 30 also includes an inlet 41*a* and an outlet 41*b* at opposing ends 42*a*, 42*b* thereof that are in fluid communication with each other. The inlet 41*a* is disposed at the top portion 36 and the outlet 41*b* is disposed at the bottom portion 40. The inlet 41*a* has a diameter D1 that is wider than a diameter D2 of the outlet 41*b*.

The top portion 36 has a thickness that is greater than the thickness of the intermediate portion 38 and the bottom portion 40. The top portion 36 extends radially outwardly from the intermediate portion 38 and is seated on a top side 43 of the ledge 22 of the deck adapter 16 when the drain pot 18 is installed within the body 20 of the adapter 16. In this way, a gap or space 44 (FIG. 3) is formed between the intermediate portion 38 of the body 30 of the drain pot 18 and the side wall 28 of the body 20 of the adapter 16. The top portion 36 includes a first ledge 45 and a second ledge 46. The first ledge 45 projects inwardly and is disposed at or near an end of the top portion 36 (i.e., the end of the top portion 36 is the end 42*a* of the body 30). The second ledge 46 also projects inwardly further than the first ledge 45 and is disposed at or near another end 47 of the top portion 36.

Figure 5:
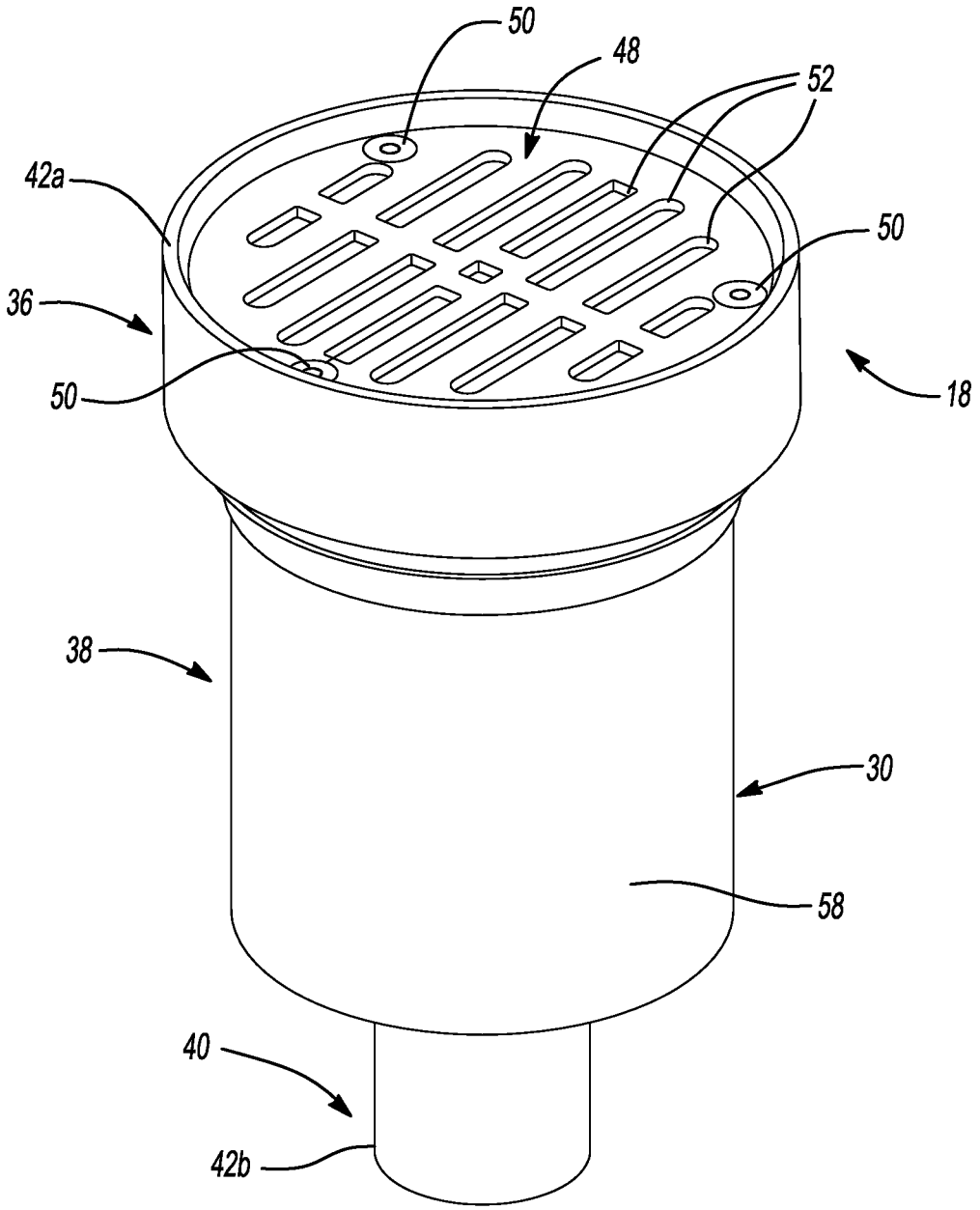
FIG. 5 is a perspective view of a drain pot of the drain apparatus.

A circular-shaped drain cover plate 48 is disposed on the first ledge 45 such that it is positioned just below the end of the top portion 36 (FIGS. 3 and 5; a gap exists between the end of the top portion 36 and the drain plate 48). The drain cover plate 48 may be made of a metal or polymeric material. The drain cover plate 48 is securely attached to the top portion 36 (via fasteners 50) and includes a plurality of slots 52 that are formed therein such that debris is separated from the fluid prior to the fluid passing through the drain plate 48.

In some configurations, the drain apparatus 10 may include a strainer assembly 53 having a funnel 54, a bowl 55 and a plurality of ribs 56. The funnel 54 is disposed on the second ledge 46 and has an opening 57 extending therethrough such that the fluid flowing through the drain pot 18 flows into the bowl 55. In this way, the bowl 55 is filled up with the fluid as the fluid flows through the drain pot 18, thereby preventing air from escaping from the drain system 14 up through the inlet 41*a* of the drain pot 18. The plurality of ribs 56 attach the funnel 54 to the bowl 55. It should be understood that other accessories may be disposed on the second ledge 46 instead of the strainer assembly 53. For example, in some configurations, a perforated plate (not shown) may be disposed on the second ledge 46, thereby further separating debris from the fluid draining from the floor 13. Openings (not shown) formed in the perforated plate (not shown) may be narrower than the slots 52 formed in the drain plate 48 such that smaller debris that flows through the drain plate 48 may be separated from the fluid prior to the fluid flowing through the perforated plate.

The intermediate portion 38 includes a side wall 58 and a sloped wall 60. The side wall 58 extends downwardly from the another end 47 of the top portion 36. The sloped wall 60 extends downwardly at angle from or near an end of the side wall 58 so as to direct fluid flowing through the drain pot 18 to the drain system 14 attached thereto (via the fitting 15). The bottom portion 40 extends downwardly from an end of the sloped wall 60 and is disposed within the fitting 15 (e.g., a 90 degree elbow fitting). The bottom portion 40 is securely attached the fitting 15 using solvent cementing, fusion techniques (e.g., thermofusion), or mechanical connections, for example.

The plurality of flexible catches 32 extend downwardly from the another end 47 of the top portion 36 and are disposed around the top portion 36 of the body 30. Each flexible catch 32 includes a first member 62 and a second member 64. The first member 62 extends in an axial direction from the another end 47 of the top portion 36. The second member 64 projects radially outwardly from an end of the first member 62. When the drain pot 18 is fully inserted into the opening 12 in the floor 13, the plurality of flexible catches 32 snap into engagement with the ledge 22 of the adapter 16 such that the drain pot 18 is locked into place (i.e., the second member 64 contacts a bottom side 66 of the ledge 22 to prevent the drain pot 18 from being removed from the opening 12 in the floor 13).

The fire stop 19 is annular-shaped and made of intumescent material. The fire stop 19 is removably installed from below in the gap 44 formed between the intermediate portion 38 of the drain pot 18 and the side wall 28 of the adapter 16 such that the fire stop 19 expands inwardly in the event of a fire, thereby pinching the drain pot 18 shut and restricting the fire from traveling between levels of the marine vessel, for example, via the drain pot 18. The fire stop 19 includes an annular body 68 and a flange 70. The annular body 68 includes a top end 72, a bottom end 74 and a side wall 76 extending from the top end 72 to the bottom end 74. The top end 72 is adjacent to the plurality of flexible catches 32. An outer surface 78 of the side wall 76 contacts the side wall 28 of the adapter 16 and an inner surface 80 of the side wall 76 contacts the intermediate portion 38 of the drain pot 18. The flange 70 extends radially outwardly from the bottom end 74 of the body 68 and is configured to abut against the bottom end 26 of the adapter 16 when the fire stop 19 is fully installed in the gap 44.

With continued reference to FIGS. 1-5, installation and removal of the drain apparatus 10 within the opening 12 in the floor 13 will be described in detail. To install the drain apparatus 10 within the opening 12 in the floor 13, the adapter 16 is first disposed in the opening 12 in the floor 13 and is also fixedly attached to the floor 13 via welding, for example. The drain pot 18 is then installed within the body 20 of the adapter 16 such that the plurality of flexible catches 32 snap into engagement with the ledge 22 of the adapter 16. In this way, the drain pot 18 is locked into place (i.e., the second member 64 contacts the bottom side 66 of the ledge 22 to prevent the drain pot 18 from being removed from the opening 12 in the floor 13). The fire stop 19 is then installed from below in the gap 44 formed between the intermediate portion 38 of the drain pot 18 and the side wall 28 of the adapter 16 such that the fire stop 19 expands inwardly in the event of a fire, thereby pinching the drain pot 18 shut and restricting the fire from traveling between levels of the marine vessel, for example, via the drain pot 18. Lastly, the bottom portion 40 of the drain pot 18 is securely attached to the drain system 14 (via the fitting 15).

The drain pot 18 is removed from the opening 12 in the floor 13 by first disconnecting the fitting 15 attached to the bottom portion 40 of the drain pot 18. The fire stop 19 is then removed from the gap 44 formed between the intermediate portion 38 of the drain pot 18 and the side wall 28 of the adapter 16. The plurality of flexible catches 32 are then biased inwardly (or broken) such that the second member 64 of the flexible catches 32 do not contact the bottom side 66 of the ledge 22 of the adapter 16. In this way, the drain pot 18 is removed from the opening 12 in the floor 13 and a new drain pot may be installed therein.

The drain pot 18 of the present disclosure is not subject to corrosion due to use of polymeric material. The drain pot 18 of the present disclosure also features a convenient snap in place installation method, thereby avoiding the need to cut or weld the floor (i.e., the deck of the marine vessel) when replacing or changing out the drain pot 18.

Figure 6:
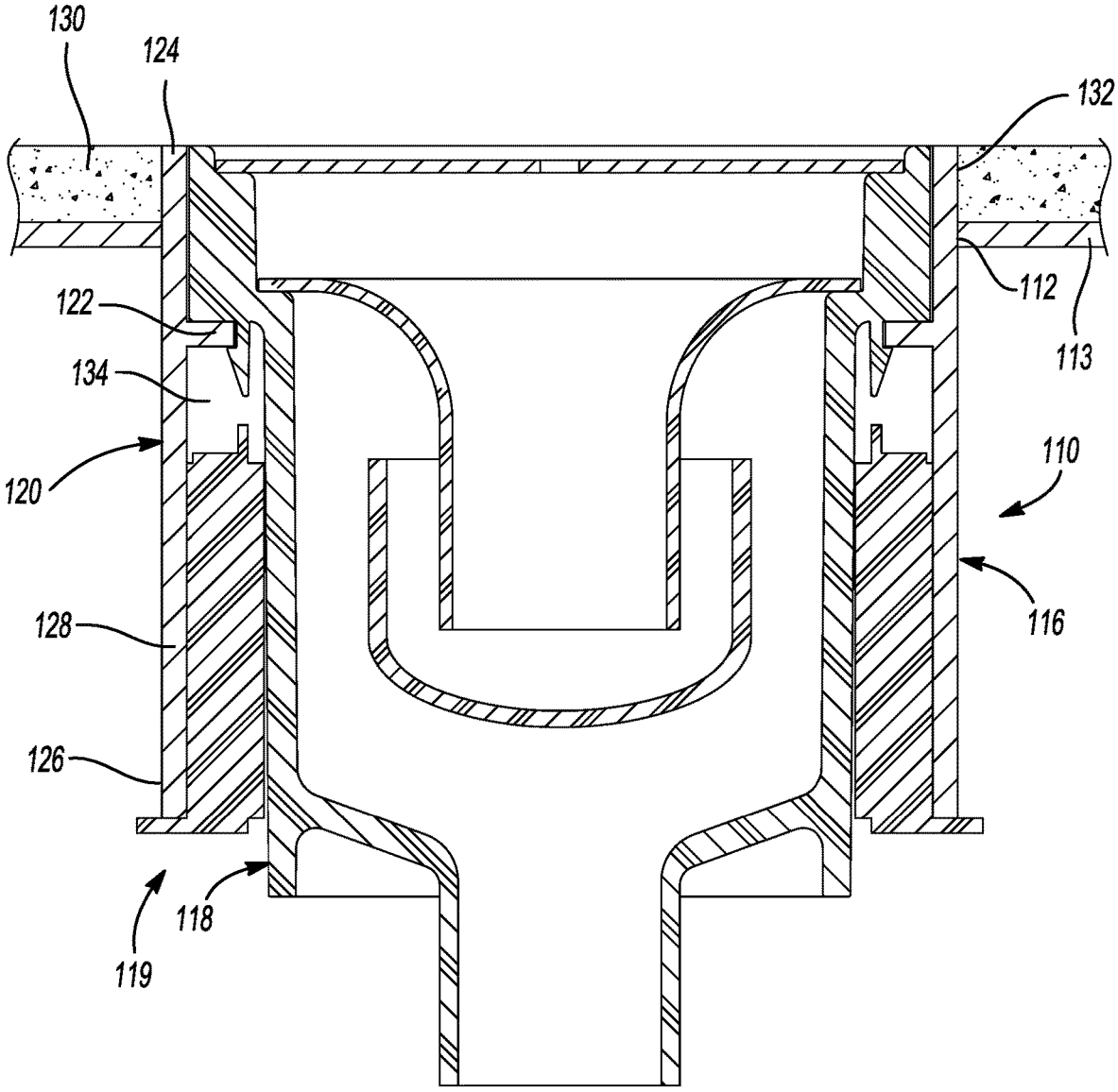
FIG. 6 is a cross-sectional view of another drain apparatus.
Figure 7:
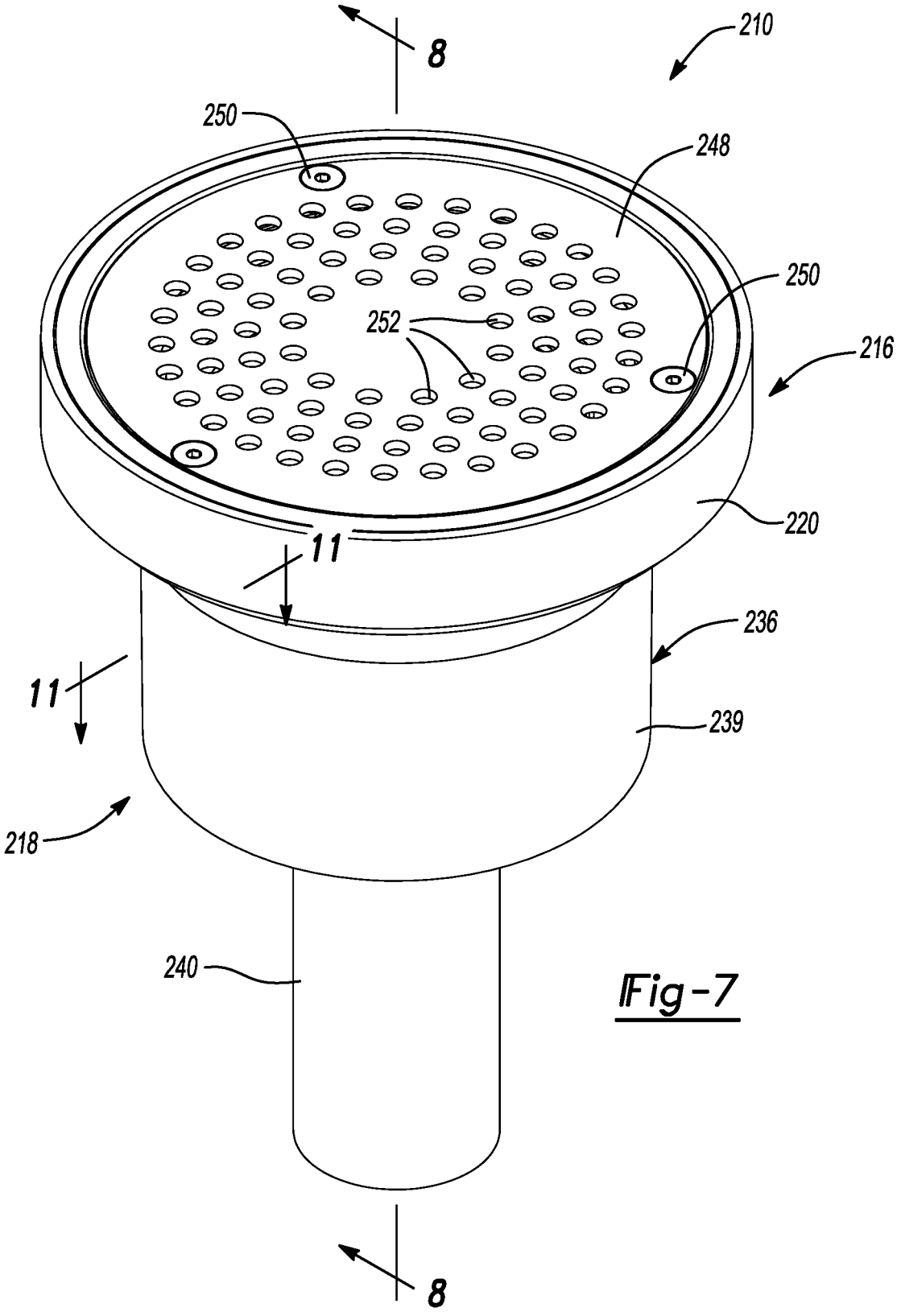
FIG. 7 is a perspective view of another drain apparatus according to the principles of the present disclosure.

With reference to FIG. 6, another drain apparatus 110 is provided. The structure and function of the drain apparatus 110 may be similar or identical to the drain apparatus 10 described above, apart from any exception described above.

The drain apparatus 110 is disposed within an opening 112 in a first floor 113 (e.g., a deck in a marine vessel) and includes a deck adapter 116, a drain pot 118 and a fire stop 119. The deck adapter 116 is annular-shaped and made of a metallic material. The deck adapter 116 is disposed within the opening 112 in the first floor 113 and is fixedly attached to the first floor 113 using any suitable method of attachment (e.g., welding). The deck adapter 116 includes an annular body 120 and a ledge 122.

The annular body 120 includes a top end 124, a bottom end 126 and a side wall 128 extending from the top end 124 to the bottom end 126. The top end 124 protrudes upwardly from the floor 113 when the deck adapter 116 is fixedly attached to the first floor 113. In this way, a second floor 130 (e.g., a finished floor) having an opening 132 may be disposed on top of the first floor 113 such that the drain apparatus 110 is received in the opening 132 and the second floor 130 lies flushed with the top end 124 of the body 120. The ledge 122 extends radially inwardly from the side wall 128 of the body 120.

The drain apparatus 118 may be similar or identical to the drain pot 18 described above, and therefore, will not be described again in detail. The drain pot 118 is configured to be removably installed within the body 120 of the adapter 116 such that fluids and debris on the second floor 130 may drain therefrom and into the drain system (not shown) attached to the drain pot 118. The fire stop 119 may be similar or identical to the fire stop 19 described above, and therefore, will not be described again in detail. The fire stop 119 is removably installed from below in a gap 134 formed between the drain pot 118 and the side wall 128 of the adapter 116 such that the fire stop 119 expands inwardly in the event of a fire, thereby pinching the drain pot 118 shut and restricting the fire from traveling between levels of the marine vessel, for example, via the drain pot 118.

With reference to FIGS. 7-12, another drain apparatus 210 is provided. The structure and function of the drain apparatus 210 may be similar or identical to the drain apparatuses 10, 110 described above, apart from any exception noted below.

The drain apparatus 210 includes a deck adapter 216 and a drain pot 218. The deck adapter 216 is made of a metallic material and is disposed within the opening 12 in the floor 13. The deck adapter 216 is fixedly attached to the floor 13 using any suitable method of attachment (e.g., welding) and includes a first annular body 220 and a second annular body 222.

Figure 8:
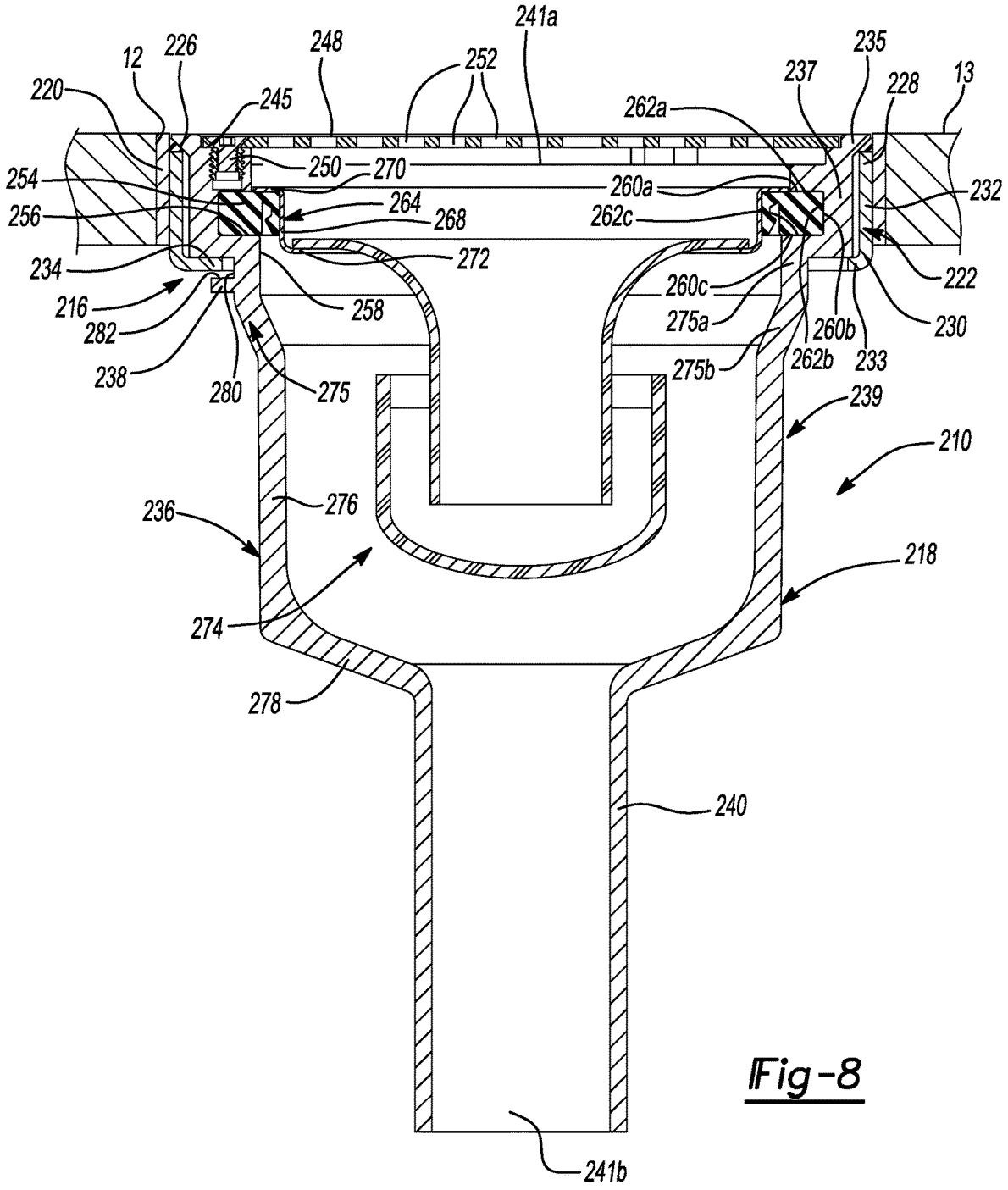
FIG. 8 is a cross-sectional view of the drain apparatus taken along line 8-8 of FIG. 7.

As shown in FIG. 8, the first annular body 220 is disposed within the opening 12 in the floor 13 and is fixedly attached to the floor 13 using any suitable method of attachment (e.g., welding). The first annular body 220 is configured to lie flush with the floor 13. The second annular body 222 is disposed within the first annular body 220 and is fixedly attached to the first annular body 220 using any suitable method of attachment (e.g., welding). The second annular body 222 is positioned below the floor 13 and a top end of the first annular body 220, and cooperates with the drain pot 218 and the first annular body 220 to define a space that receives an annular sealing member 226.

Figure 9:
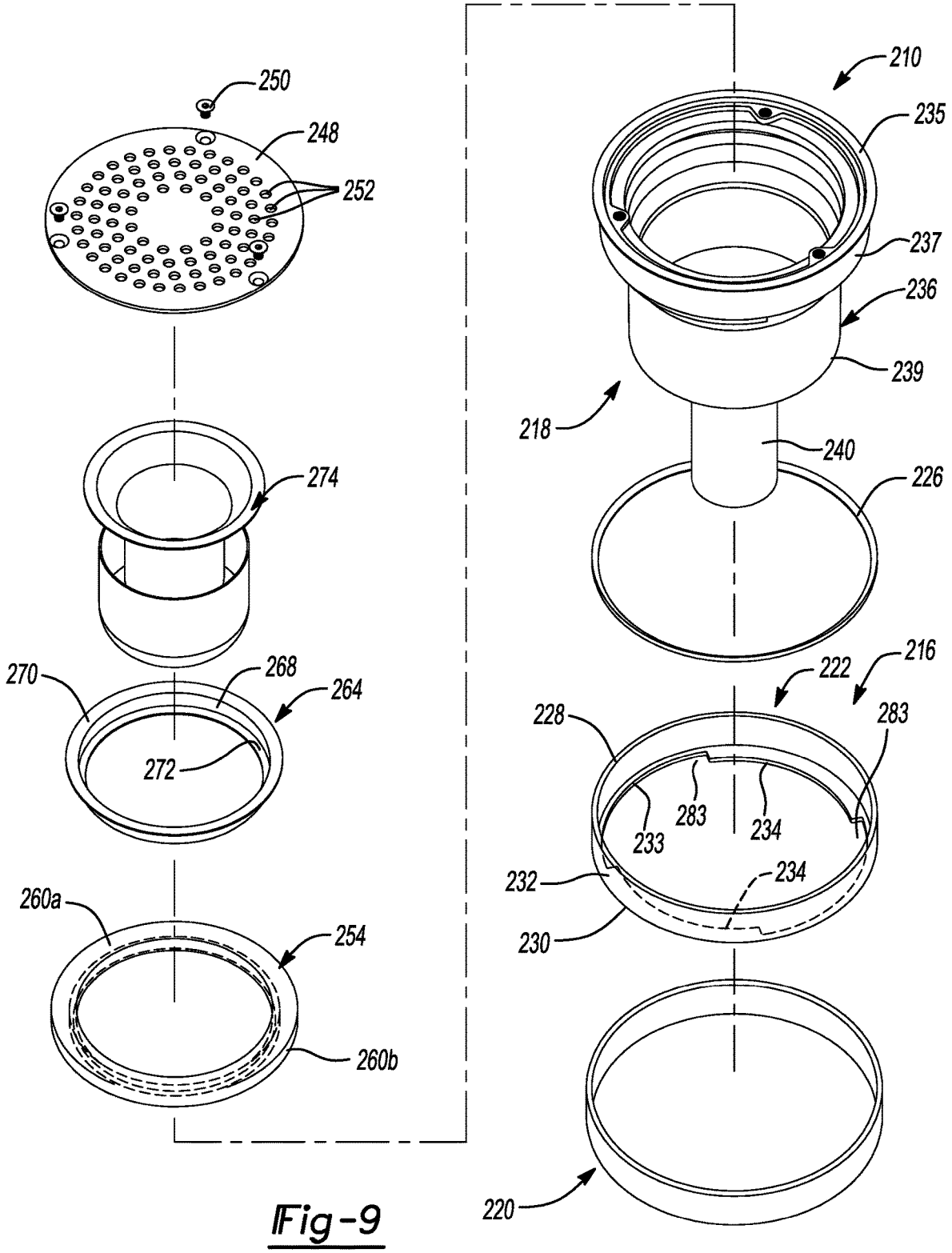
FIG. 9 is an exploded view of the drain apparatus of FIG. 7.
Figure 10:
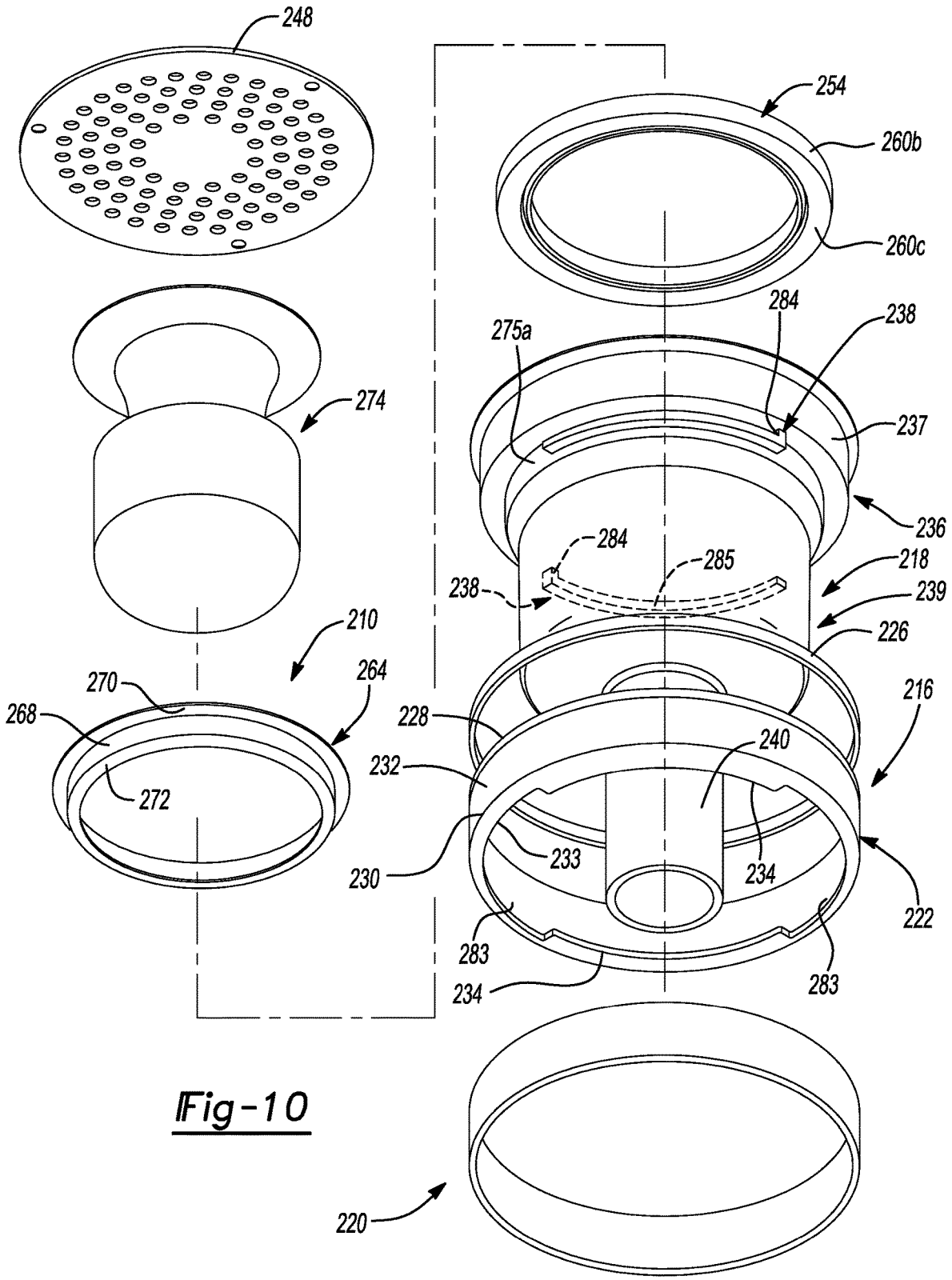
FIG. 10 is another exploded view of the drain apparatus of FIG. 7.

The second annular body 222 includes a top end 228, a bottom end 230, a side wall 232 and a lip 233. The side wall 232 extends from the top end 228 to the bottom end 230. As shown in FIGS. 9 and 10, the lip 233 extends radially inwardly from the bottom end 230 of the second annular body 222. A plurality of arcuate-shaped ledges 234 are disposed around the lip 233 and are spaced apart from each other. The plurality of ledges 234 also extend radially inwardly from the lip 233 of the second annular body 222 (i.e., the ledges 234 extend radially inwardly a further distance than the lip 233 extends radially inwardly).

The drain pot 218 is annular-shaped and made of a polymeric material (e.g., cPVC). The drain pot 218 is configured to be removably installed within the second body 222 of the adapter 216 such that fluids and debris on the floor 13 may drain therefrom and into the drain system (not shown) attached to the drain pot 218. The drain pot 218 includes a body 236 and a plurality of catches or protrusions 238 (FIGS. 8 and 10).

The body 236 is annular-shaped and includes a flange 235, a top portion or shoulder 237, an intermediate portion 239 and a bottom portion or spigot 240. The body 236 also includes an inlet 241*a* and an outlet 241*b* at opposing ends thereof that are in fluid communication with each other. The inlet 241*a* is disposed at the top portion 237 and the outlet 241*b* is disposed at the bottom portion 240.

The flange 235 extends radially outwardly from an end of the top portion 237 and cooperates with the first and second bodies 220, 222 to define the space that receives the sealing member 226. The top portion 237 extends radially outwardly from the intermediate portion 239 and is seated on the lip 233 and the ledges 234 of the second body 222 of the deck adapter 216 when the drain pot 218 is installed within the second annular body 222. The top portion 237 includes a ledge 245. The ledge 245 projects inwardly and is disposed at or near an end of the top portion 237.

A circular-shaped drain cover plate 248 is disposed on the ledge 245 such that the cover plate 248 is flush with the floor 13. The drain cover plate 248 may be made of a metal or polymeric material. The drain cover plate 248 is securely attached to the top portion 237 (via fasteners 250) and includes a plurality of openings 252 that are formed therein such that debris is separated from the fluid prior to the fluid passing through the drain plate 248.

As shown in FIG. 8, an annular sealing member 254 is disposed within an annular groove 256 formed in an inner diametrical surface 258 of the top portion 237. The annular sealing member 254 is made of a resiliently compressible material and has outer surfaces 260*a*, 260*b*, 260*c* that are sealingly engaged with surfaces 262*a*, 262*b*, 262*c*, respectively, of the groove 256. A bracket 264 is attached (e.g., snug-fitted) within the sealing member 254 and is seated on the surface 260*a* of the sealing member 254. The bracket 264 includes a sidewall 268, a flange 270 and a ledge 272. The sidewall 268 is sealingly engaged with the sealing member 254. The flange 270 extends radially outwardly from an upper end of the sidewall 268 and is seated on the surface 260*a* of the sealing member 254. The flange 270 is also sealingly engaged with the top surface 266 of the sealing member 254. The ledge 272 extends radially inwardly from a bottom end of the sidewall 268 and is positioned below the sealing member 254.

In some configurations, the drain apparatus 210 may include a strainer assembly 274 that is seated on the ledge 272 of the bracket 264 (FIG. 8). The structure and function of the strainer assembly 274 may be similar or identical to that of strainer assembly 53 described above, and therefore, will not be described again in detail.

The intermediate portion 239 includes a catch wall 275, a side wall 276 and a sloped wall 278. The catch wall 275 extends downwardly from the top portion 237 and includes a vertical portion 275*a* and a sloped portion 275*b*. The sloped portion 275*b* extends downwardly at an angle from the vertical portion 275*a*. The side wall 276 extends downwardly from the sloped portion 275*b* of the catch wall 275. The sloped wall 278 extends downwardly at angle from or near an end of the side wall 276 so as to direct fluid flowing through the drain pot 218 to the drain system (not shown) attached thereto. The bottom portion 240 extends downwardly from an end of the sloped wall 278.

As shown in FIG. 10, the arcuate shaped catches 238 are disposed around an upper end of the catch wall 275 of the intermediate portion 239 and are spaced apart from each other. The catches 238 are rigid (i.e., not flexible). Each catch 238 extends radially outwardly from an outer diametrical surface 280 of the vertical portion 275*a* of the catch wall 275 and cooperates with the top portion 237 to define a slot or groove 282. Each catch 238 includes a vertical member 284 and an elongated horizontal member 285 that extends from an end of the vertical member 284.

With continued reference to FIGS. 7-12, installation and removal of the drain apparatus 210 within the opening 12 in the floor 13 will be described in detail. To install the drain apparatus 210 within the opening 12 in the floor 13, the adapter 216 is first disposed in the opening 12 in the floor 13 and is also fixedly attached to the floor 13 as described above. The drain pot 218 is then disposed over the opening 12 such that the catches 238 are aligned with respective gaps 283 between the ledges 234 of the second body 222.

Figure 11:
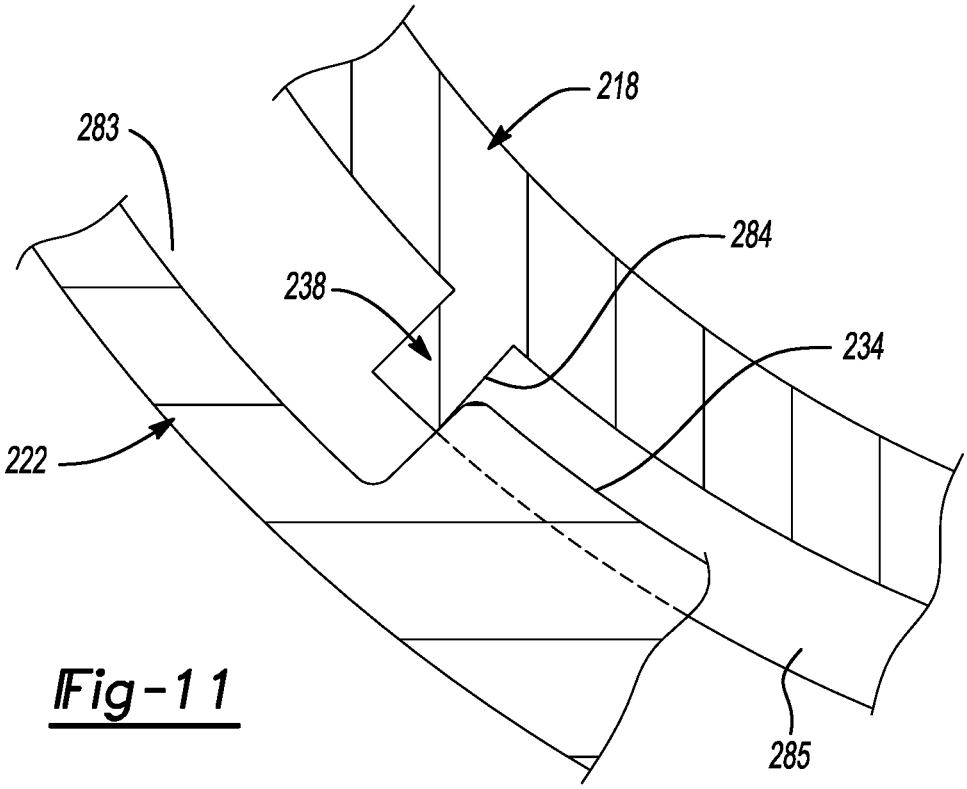
FIG. 11 is a cross-sectional view of the drain apparatus taken along line 11-11 of FIG. 7.
Figure 12:
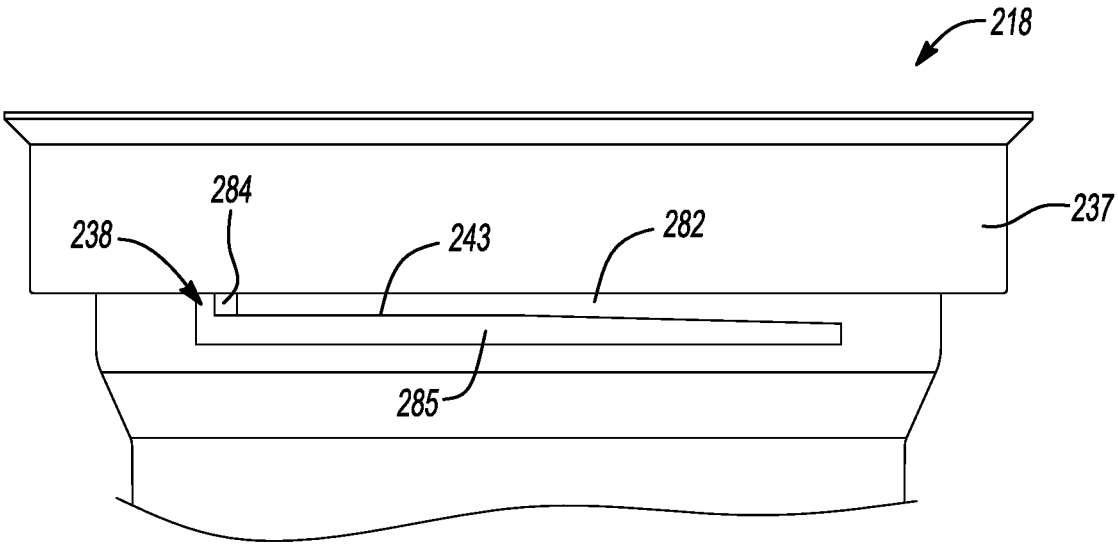
FIG. 12 is a partial side view of a drain pot of the drain apparatus.
Figure 13:
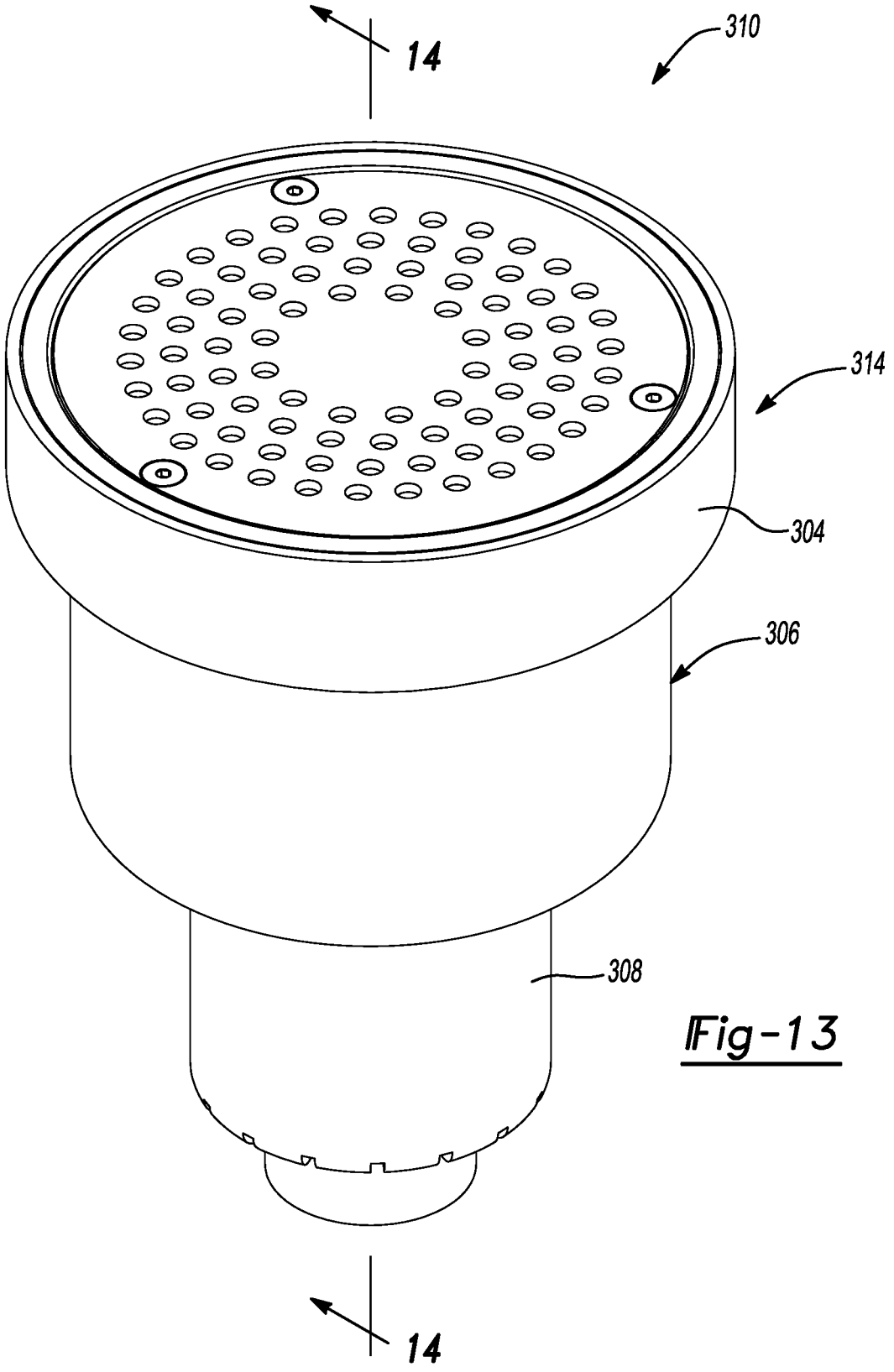
FIG. 13 is a perspective view of another drain apparatus according to the principles of the present disclosure.

The drain pot 218 is then inserted into the opening 12 until the ledges 234 of the second body 222 are positioned between catches 238 and a bottom end of the top portion 237 (i.e., the ledges 234 are aligned with the slots 282 defined by the catches 238 and the top portion 237). The drain pot 218 is then rotated such that each ledge 234 is received in a respective slot 282 and one opposing end of the ledge 234 abuts against the vertical member 284 of the catch 238 (FIG. 11). In this way, the drain pot 218 is locked into place (i.e., the catches 238 and the top portion 237 restrict axial movement of the drain pot 218 within the opening 12). It is understood that the vertical member 284 of each catch 238 allows for rotation of the drain pot 218 in only one direction. The horizontal member 285 of the catch 238 has a ramped surface 243 (FIG. 12) to facilitate placement and securement of the ledge 234 in the slot 282.

The drain pot 218 is removed from the opening 12 in the floor 13 by first being rotated (i.e., rotated in an opposite direction that it was rotated to install the drain pot 218 within the opening 12) until each ledge 234 of the second body 222 is removed from the respective slot 282 (i.e., the catches 238 are positioned in respective gaps 283 between the ledges 234). The drain pot 218 is then removed from the opening 12 in the floor 13.

With reference to FIG. 13-16, another drain apparatus 310 is provided. The structure and function of the drain apparatus 310 may be similar or identical to the drain apparatuses 10, 110, 210 described above, apart from any exception noted below.

Figure 14:
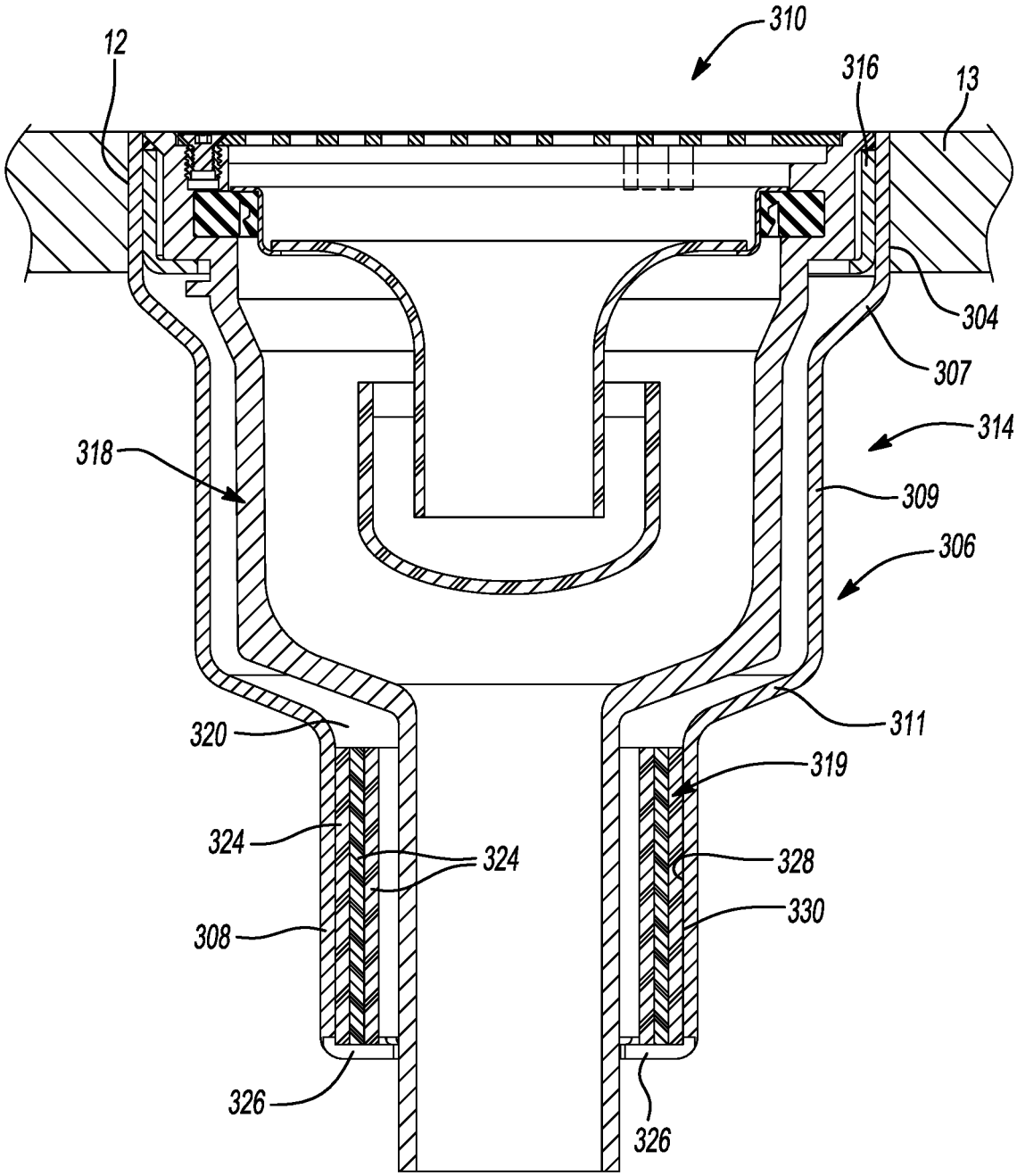
FIG. 14 is a cross-sectional view of the drain apparatus taken along line 14-14 of FIG. 13.
Figure 16:
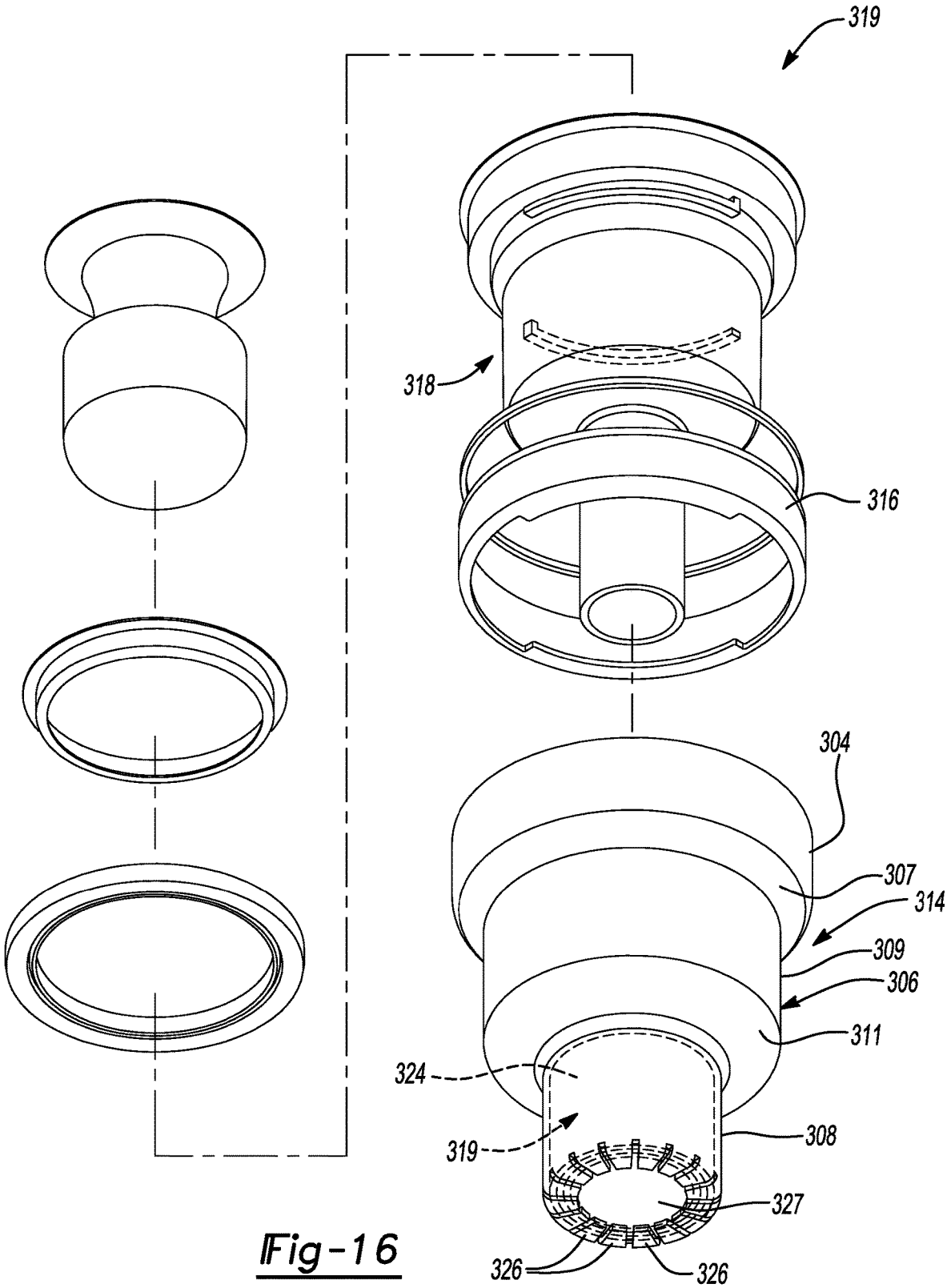
FIG. 16 is another exploded view of the drain apparatus of FIG. 13.

The drain apparatus 310 includes a housing 314, a deck adapter 316 and a drain pot 318. The housing 314 is made of a metallic material and is disposed within the opening 12 in the floor 13 (FIG. 14). The housing 314 is fixedly attached to the floor 13 using any suitable method of attachment (e.g., welding). The housing 314 includes a top portion 304, an intermediate portion 306 and a bottom portion 308. The intermediate portion 306 includes a first sloped wall 307, a side wall 309 and a second sloped wall 311. The first sloped wall 307 extends downwardly at an angle from the top portion 304. The side wall 309 extends downwardly from the side wall 309. The second sloped wall 311 extends downwardly at angle from or near an end of the side wall 309. The bottom portion 308 extends downwardly from an end of the second sloped wall 311. As shown in FIG. 16, a plurality of fingers 326 extend radially inwardly from an end of the bottom portion 308 and define an opening 327. The fingers 326 are spaced apart from each other.

The deck adapter 316 is disposed within the housing 314 and is attached (e.g., welded) to the housing 314. The structure and function of the deck adapter 316 may be identical or similar to that of the body 222 described above, and therefore, will not be described again in detail. The drain pot 318 is configured to be removably installed within the deck adapter 316. The structure and function of the drain pot 318 may be identical or similar to that of the drain pot 218 described above, and therefore, will not be described again in detail. When the drain pot 318 is installed within the deck adapter 316, a portion of the drain pot 318 extends through the opening 327 of the housing 314 (FIG. 14).

Figure 15:
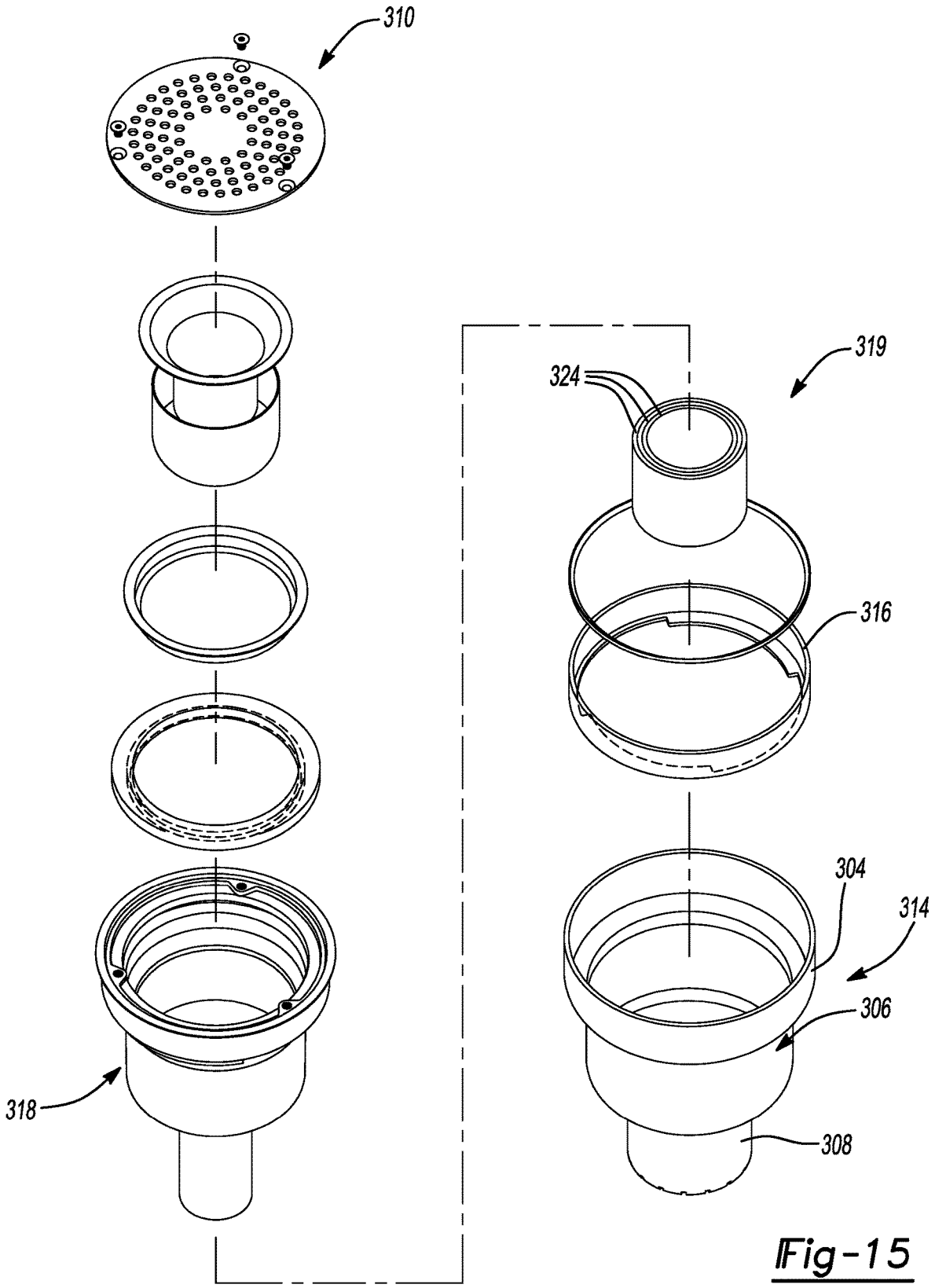
FIG. 15 is an exploded view of the drain apparatus of FIG. 13.

As shown in FIG. 15, a fire stop 319 is annular-shaped and made of intumescent material. The fire stop 319 is removably installed in a gap 320 formed between the bottom portion 308 of the housing 314 and the drain pot 318 such that the fire stop 319 expands inwardly in the event of a fire, thereby pinching the drain pot 318 shut and restricting the fire from traveling between levels of the marine vessel, for example, via the drain pot 318. The fire stop 319 includes a plurality of cylindrical-shaped bodies 324 that are concentric to each other. The bodies 324 rest on the fingers 326. As shown in FIG. 14, an outer diametrical surface 330 of the outermost body 324 is configured to abut against an inner diametrical surface 328 of the bottom portion 308 and the inner most body 324 is spaced apart from the drain pot 318 when the fire stop 319 is fully installed.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A drain pot for a deck in a marine vessel comprising:

a body having an inlet and an outlet, the inlet and the outlet at opposing ends of the body and in fluid communication with each other;

at least one elongated catch extending from and at least partially around the body, wherein a portion of the body extends radially outwardly further than the at least one elongated catch; and wherein the catch is configured to engage another member to lock the body in place upon rotation of the body.

2. The drain pot of claim 1, wherein the body is annular-shaped.

3. The drain pot of claim 2, wherein the body includes a top portion, bottom portion and an intermediate portion disposed between the top portion and the bottom portion, and wherein the inlet is disposed at the top portion and the outlet is disposed at the bottom portion.

4. The drain pot of claim 3, wherein the at least one elongated catch extends from the intermediate portion of the body and cooperates with the top portion to define a slot.

5. The drain pot of claim 1, wherein the at least one elongated catch is arcuate.

6. The drain pot of claim 1, wherein the body and the at least one elongated catch is made of a polymeric material.

7. The drain pot of claim 1, wherein the at least one elongated catch includes a vertical member and a horizontal member that extends from an end of the vertical member.

8. A drain apparatus for a deck in a marine vessel, the drain apparatus comprising:

an adapter disposed within an opening in the deck of the marine vessel and attached to the deck of the marine vessel; and a drain pot configured to be removably installed within the adapter and including a body and at least one elongated catch, the body having an inlet and an outlet at opposing ends thereof and in fluid communication with each other, the at least one elongated catch extending from and disposed at least partially around the body and engaging the adapter.

9. The drain apparatus of claim 8, further comprising a housing disposed within the opening in the deck and attached to the deck, the adapter disposed within the housing and fixedly attached to the housing.

10. The drain apparatus of claim 9, further comprising a fire stop configured to be removably installed in a gap formed between the housing and the body of the drain pot.

11. The drain apparatus of claim 10, wherein the drain pot is made of a polymeric material.

12. A drain apparatus for a deck in a marine vessel, the drain apparatus comprising:

an annular deck adapter configured to fit within an opening in the deck of the marine vessel; the adapter including:

an annular body having a top end, a bottom end and a side wall extending from the top end to the bottom end;

the body extending downwardly in the opening in the deck;

a lip extending radially inwardly from the bottom end of the body;

a ledge extending radially inwardly from the lip such that the ledge extends radially inwardly a further distance than the lip; and a drain pot configured to be removably installed within the body of the adapter.

13. The drain apparatus of claim 12, wherein the drain pot includes at least one elongated catch for engaging the ledge of the adapter.

14. The drain apparatus of claim 13, wherein the top end of the body is positioned below a surface of the deck.

15. The drain apparatus of claim 14, wherein the drain pot includes a body having a top portion, bottom portion and an intermediate portion extending between the top portion and the bottom portion.

16. The drain apparatus of claim 15, wherein the top portion extends radially outwardly from the intermediate portion and is seated on a top side of the ledge of the adapter.

17. The drain apparatus of claim 16, further comprising a drain plate disposed on an inwardly projecting ledge formed in the top portion of the drain pot, above the ledge of the adapter and adjacent an end of the body of the drain pot.

18. The drain apparatus of claim 15, wherein the at least one elongated catch extends from the body of the drain pot and cooperates with the top portion to define a slot.

19. The drain apparatus of claim 18, wherein the drain pot is inserted into the adapter and rotated in one direction so that the ledge is received in the slot to prevent the drain pot from being removed from the opening in the deck and wherein the drain pot is removed from the slot by rotating the drain pot in an opposite direction to disengage the ledge from the slot to allow the drain pot to be removed from the opening in the deck.

20. The drain apparatus of claim 19, wherein the catch is arcuate.

* * * * *